US011565155B1

(12) United States Patent
Chen

(10) Patent No.: US 11,565,155 B1
(45) Date of Patent: Jan. 31, 2023

(54) SPORTS BALL

(71) Applicant: ZHANGZHOU CITY GUANTENG SPORTS PRODUCTS CO., LTD., Zhangzhou (CN)

(72) Inventor: Lucheng Chen, Zhangzhou (CN)

(73) Assignee: ZHANGZHOU CITY GUANTENG SPORTS PRODUCTS CO., LTD., Zhangzhou (CN)

( * ) Notice: Subject to any disclaimer, the term of this patent is extended or adjusted under 35 U.S.C. 154(b) by 0 days.

(21) Appl. No.: 17/729,021

(22) Filed: Apr. 26, 2022

(51) Int. Cl.
*A63B 41/08* (2006.01)

(52) U.S. Cl.
CPC ..... *A63B 41/08* (2013.01); *A63B 2209/00* (2013.01)

(58) Field of Classification Search
CPC ... A63B 41/08; A63B 2209/00; A63B 43/008; A63B 43/06
See application file for complete search history.

(56) References Cited

U.S. PATENT DOCUMENTS 4,867,452 A * 9/1989 Finley ..... A63B 43/06 473/569
10,258,836 B2 * 4/2019 Molinari ..... A63B 41/08
2001/0027142 A1 * 10/2001 Kennedy, III ..... G09F 23/0066 473/604
2004/0266553 A1 * 12/2004 Park ..... A63B 37/00221 473/378
2004/0266554 A1 * 12/2004 Park ..... A63B 37/0003 473/371
2004/0266555 A1 * 12/2004 Park ..... A63B 37/0003 473/371
2009/0023518 A1 * 1/2009 Lee ..... C09K 11/06 473/378
2011/0224020 A1 * 9/2011 Tachibana ..... A63B 43/008 473/378
2013/0109505 A1 * 5/2013 Wachi ..... A63B 43/008 427/157
2021/0022444 A1 * 1/2021 Gantz ..... A41D 27/08

FOREIGN PATENT DOCUMENTS

CN 101422646 A * 5/2009
CN 202410020 U * 9/2012
CN 107050778 A * 8/2017 ..... A63B 41/00
CN 107158667 A * 9/2017 ..... A63B 41/00
CN 113440814 A * 9/2021

* cited by examiner

*Primary Examiner* — Steven B Wong
(74) *Attorney, Agent, or Firm* — Bayramoglu Law Offices LLC

(57) ABSTRACT

A sports ball includes an inflatable ball or a non-inflatable ball. A photosensitive layer is provided on an outer side of the non-inflatable ball. The inflatable ball includes an inner bladder. An outer side of the inner bladder is bonded to a patch layer through an adhesive layer. A valve core is fixed and penetrates from an inner side of the inner bladder to an outer side of the patch layer, such that the inner side of the inner bladder communicates with the outer side of the patch layer through the valve core. A spacer groove is formed between the outer side of the inner bladder and the patch layer. A sealing strip is bonded to an inner side of the spacer groove; and the photosensitive layer is provided on the outer side of the patch layer. The photosensitive layer includes UV photochromic powder.

2 Claims, 2 Drawing Sheets

SPORTS BALL

TECHNICAL FIELD

The present disclosure belongs to the technical field of sports goods, and particularly relates to a sports ball.

BACKGROUND

There are a variety of ball games, including basketball, volleyball, football and table tennis, which are played during the day and night.

With the improvement of people's living standards, the existing sports balls can no longer meet the needs of consumers due to their monotonous appearance color.

SUMMARY

(1) Technical Problem to be Solved

In order to overcome the above shortcoming of the prior art, the present disclosure provides a sports ball, which is ultraviolet (UV)-photochromic and luminous to enhance its appearance color expression.

(2) Technical Solution

The present disclosure is achieved by the following technical solution. The present disclosure provides a sports ball. The sports ball includes an inflatable ball or a non-inflatable ball, where a photosensitive layer is provided on an outer side of the non-inflatable ball;

the inflatable ball includes an inner bladder; an outer side of the inner bladder is bonded to a patch layer through an adhesive layer; a valve core is fixed and penetrates from an inner side of the inner bladder to an outer side of the patch layer, such that the inner side of the inner bladder communicates with the outer side of the patch layer through the valve core; a spacer groove is formed between the outer side of the inner bladder and the patch layer; a sealing strip is bonded to an inner side of the spacer groove; and the photosensitive layer is provided on the outer side of the patch layer;

the photosensitive layer is made by uniformly mixing UV photochromic powder, a phosphor, transparent essential oil, and toluene;

the adhesive layer is made by uniformly mixing resin glue and an anti-aging agent; and an outer side of the photosensitive layer is provided with a wear-resistant coating.

(3) Advantages

Compared with the prior art, the present disclosure has the following advantages:

The photosensitive layer is provided on the outer side of the patch layer of the inflatable ball or the outer side of the non-inflatable ball. The UV photochromic powder presents different colors in response to light, and the phosphor glows in case of dim light. This design facilitates the position determination of the ball, and enhances the appearance color expression so as to improve the ball's attraction to the consumers.

BRIEF DESCRIPTION OF DRAWINGS

Other features, objectives, and advantages of the present disclosure will become more apparent by reading the detailed description of non-limiting embodiments with reference to the following accompanying drawings.

Figure 1:
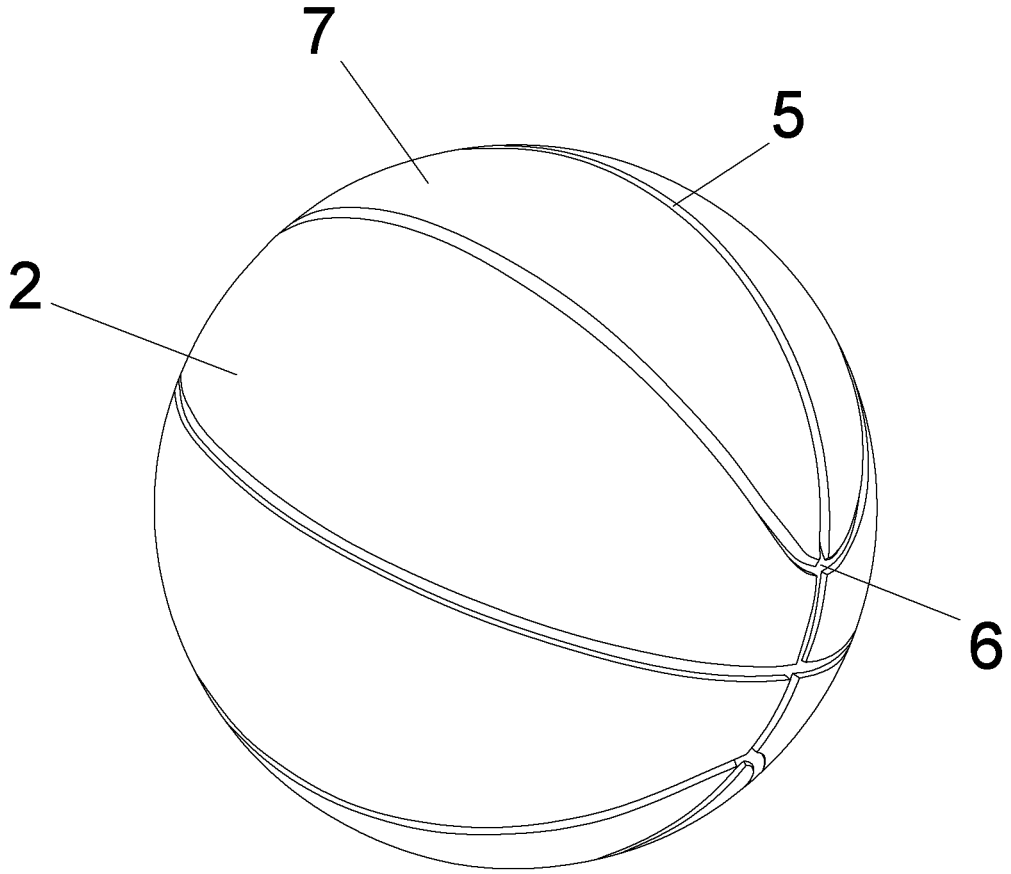
FIG. 1 is a structural view of an inflatable ball according to the present disclosure.

Reference Numerals: 1. inner bladder; 2. patch layer; 3. adhesive layer; 4. valve core; 5. spacer groove; 6. sealing strip; and 7. photosensitive layer.

DETAILED DESCRIPTION OF THE EMBODIMENTS

Embodiment 1

Figure 2:
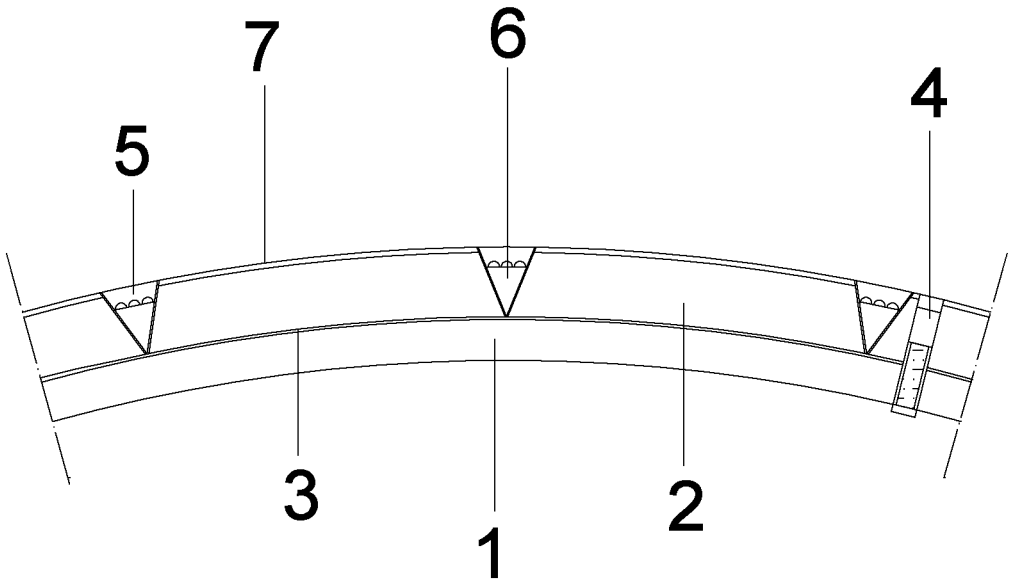
FIG. 2 is a partial view showing the interior structure of the inflatable ball according to the present disclosure.

Referring to FIGS. 1 and 2, the present disclosure provides a sports ball. The sports ball includes an inflatable ball. The inflatable ball includes an inner bladder 1. An outer side of the inner bladder 1 is bonded to a patch layer 2 through an adhesive layer 3.

The adhesive layer 3 is made by uniformly mixing resin glue and an anti-aging agent. The resin glue is used to improve the peel resistance after bonding, and the anti-aging agent is used to prolong the aging life thereof.

A valve core 4 is fixed and penetrates from an inner side of the inner bladder 1 to an outer side of the patch layer 2, such that the inner side of the inner bladder 1 communicates with the outer side of the patch layer 2 through the valve core 4. A spacer groove 5 is formed between the outer side of the inner bladder 1 and the patch layer 2. A sealing strip 6 is bonded to an inner side of the spacer groove 5. A photosensitive layer 7 is provided on the outer side of the patch layer 2. An outer side of the photosensitive layer 7 is provided with a wear-resistant coating to protect the photosensitive layer 7.

The photosensitive layer 7 is made by uniformly mixing UV photochromic powder, a phosphor, transparent essential oil, and toluene.

An outer end of the valve core 4 is not exposed to the outer side of the patch layer 2.

An outer side of the sealing strip 6 is provided with anti-skid bumps to increase friction and facilitate use.

The outer side of the photosensitive layer 7 is provided with a wear-resistant coating.

The inflatable ball may be a basketball, a volleyball, or a football, etc.

Embodiment 2

Figure 3:
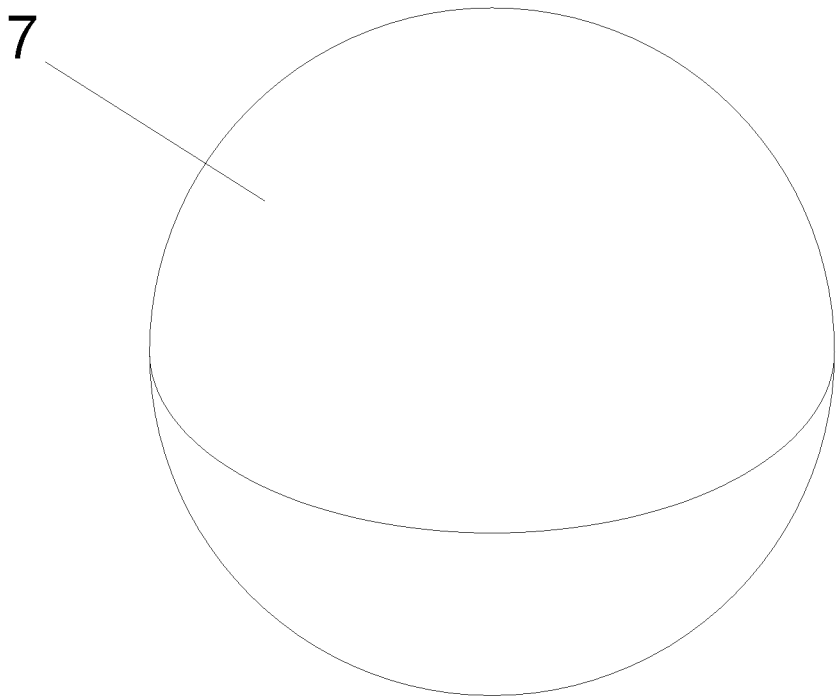
FIG. 3 is a structural view of a non-inflatable ball according to the present disclosure.

Referring to FIG. 3, the present disclosure provides a sports ball. The sports ball includes a non-inflatable ball, and a photosensitive layer 7 is provided on an outer side of the non-inflatable ball.

The photosensitive layer 7 is made by uniformly mixing UV photochromic powder, a phosphor, transparent essential oil, and toluene.

The outer side of the photosensitive layer 7 is provided with a wear-resistant coating.

The non-inflatable ball may be a table tennis ball or a bowling ball, etc.

In the present disclosure, the UV photochromic powder absorbs UV light of a specific wavelength, and changes its color by the energy of the light. When the UV light of the specific wavelength disappears, the UV photochromic powder restores its original color.

The basic principles, main features and advantages of the present disclosure are described above. For those skilled in the art, it is obvious that the present disclosure is not limited to the details of the above embodiments, and the present disclosure can be implemented in other specific forms without departing from the spirit or basic features of the present disclosure. The embodiments should be regarded as exemplary and non-limiting in every respect, and the scope of the present disclosure is defined by the appended claims rather than the above description. Therefore, all changes falling within the meaning and scope of equivalent elements of the claims should be included in the present disclosure. The reference numeral in the claims should not be considered as limiting the involved claims.

It should be understood that although this specification is described in accordance with the embodiments, not every embodiment includes only an independent technical solution. Such a description is merely for the sake of clarity, and those skilled in the art should take the specification as a whole. The technical solutions in the embodiments can also be appropriately combined to form other implementations which are comprehensible for those skilled in the art.

What is claimed is:

1. A sports ball, comprising an inflatable ball or a non-inflatable ball, wherein a photosensitive layer is provided on an outer side of the non-inflatable ball;

the inflatable ball comprises an inner bladder; an outer side of the inner bladder is bonded to a patch layer through an adhesive layer; a valve core is fixed and penetrates from an inner side of the inner bladder to an outer side of the patch layer, and the inner side of the inner bladder communicates with the outer side of the patch layer through the valve core; a spacer groove is formed between the outer side of the inner bladder and the patch layer; a sealing strip is bonded to an inner side of the spacer groove; and the photosensitive layer is provided on the outer side of the patch layer; and the photosensitive layer is made by uniformly mixing ultraviolet (UV) photochromic powder, a phosphor, transparent essential oil, and toluene.

2. The sports ball according to claim 1, wherein an outer side of the photosensitive layer is provided with a wear-resistant coating.

* * * * *